United States Patent [19]

Krydiak

[11] Patent Number: 4,750,648

[45] Date of Patent: Jun. 14, 1988

[54] LID WITH AN ADJUSTABLE POURING ARRANGEMENT, PARTICULARLY FOR USE ON STIRRING MACHINES

[75] Inventor: Alain Krydiak, Orleans, France

[73] Assignee: S.A. Fonderie & Ateliers des Sablons, France

[21] Appl. No.: 61,865

[22] Filed: Jun. 11, 1987

[30] Foreign Application Priority Data

Sep. 8, 1986 [FR] France ..... 86 12547

[51] Int. Cl.[4] ..... B67D 3/00

[52] U.S. Cl. ..... 222/484; 222/505; 222/511; 222/512; 222/561

[58] Field of Search ..... 222/512, 511, 505, 484, 222/233-235, 561, 559, 545; 251/174, 193

[56] References Cited

U.S. PATENT DOCUMENTS

| | | | |
|---|---|---|---|
| 1,742,562 | 1/1930 | Savoy | 222/511 X |
| 3,021,118 | 2/1962 | Dedoes | 222/561 X |
| 3,041,052 | 6/1962 | Dedoes | 222/484 X |
| 3,162,338 | 12/1964 | Grubelic | 222/561 X |

FOREIGN PATENT DOCUMENTS

| | | | |
|---|---|---|---|
| 2279633 | 2/1976 | France | 222/505 |

*Primary Examiner*—Joseph J. Rolla
*Assistant Examiner*—Nils E. Pedersen
*Attorney, Agent, or Firm*—Scully, Scott, Murphy & Presser

[57] ABSTRACT

A lid with an adjustable "guillotine"-type pouring arrangement, which is especially adapted for mounting on the primary color or paint containers intended for car bodywork and which are employed in stirring machines. In this lid, a flat spring which is fastened with a rearward portion to the lid, in front of a stirring shaft of the stirring machine includes at its front side, a flange pressing against a sliding element and, at a distance from the fastening location, two vertically flanges arranged on either side of and proximate each of the longitudinal edges of the sliding element. Two helical coil springs are each connected, at the one end, to each of the flanges on the flat spring and, at the other end, to the rearward portion of the sliding element.

7 Claims, 2 Drawing Sheets

LID WITH AN ADJUSTABLE POURING ARRANGEMENT, PARTICULARLY FOR USE ON STIRRING MACHINES

BACKGROUND OF THE INVENTION

1. Field of the Invention

The present invention relates to a lid with an adjustable "guillotine"-type pouring arrangement, which is especially adapted for mounting on the primary color or paint containers intended for car bodywork and which are employed in stirring machines.

2. Discussion of the Prior Art

Lids of this type usually incorporate a pouring spout, the opening portion of which is completely flat or planar. A sliding element, which is mounted on the pouring spout, is also flat and slides on the pouring spout and the opening portion when operating lever for the spout is pulled so as to enable pouring of the paint. In order to prevent as extensively as possible, any paint from adhering to the opening portion and as a result, to allow the sliding element to reopen the spout without any difficulty, the sliding element must be capable of sliding on the spout opening portion under a sufficient degree of contacting pressure so as to remove any paint depositions accumulating in this area.

SUMMARY OF THE INVENTION

Accordingly, the present invention has as an object to provide a novel and unique lid with a pouring spout, adapted for use with primary color containers which are arranged on stirring machines, and including the following structural integers:

(a) at least one member for fastening the lid on a color or paint container;

(b) a pouring spout on the lid, the opening portion of which is completely flat or planar;

(c) a movable sliding element conforming with the opening portion of the pouring spout, and which is capable of sliding on the surface of the spout;

(d) an operating lever having two arms, which lever is hinged to the lid and connected with the sliding element and is displaceable between a resting position in which the sliding element closes off the opening of the pouring spout and a retracted working position in which the paint can be poured from the container; the lid also including:

(e) a flat spring having a rear portion fixed to the lid in front of the stirring shaft of a stirring machine, the spring having on its front side, a flange pressing against the sliding element and, at a distance from the fixing location to the lid, two vertically depending lugs or flanges arranged on both sides thereof extending in proximity with each of the longitudinal side edges of the sliding element; and (f) two helical coil springs each respectively connected, at one end, to each of the depending flanges on the flat spring and, at the other end, to the rear portion of the sliding element.

As a result of this arrangement, depressing of the operating lever tensions the helical coil springs, thereby exerting a torsional moment or torque on the flat spring about its fixing point, so as to resultingly increase the pressure of the front flange of the flat spring acting on the sliding element. This action, as a consequence, increases the amount of pressure of the sliding element on the pouring spout portion, depending upon the extent to which the sliding element is opened or displaced, and is extremely effective in removing any paint which may be present between the pouring spout portion and the sliding element subsequent to pouring from the container.

According to other advantageous features of the invention, it is possible to arrange a venting orifice or passageway through the wall of the lid, behind the stirring shaft opposite the flat spring, the flat upper end surface of this venting passageway extending to and terminating below the sliding element in the sliding plane for the sliding element. In addition thereto, the sliding element is configured as to close off the venting orifice in the resting position of the operating lever and to open the orifice in the working position of the lever, thereby rendering it easier to pour the paint.

The sliding element may incorporate a longitudinal central aperture which has a width equal to the diameter of a sleeve or bushing guiding the stirring shaft; and wherein the aperture surrounds the shaft, and the external or rear end of which abuts, in the resting position, against the bushing, with the aperture exposing the venting orifice to the outside in the working position.

By opening the venting passageway during the pouring, the container is vented and, consequently, ensures the obtention of a uniform pouring rate and more precise metering for the paint.

The sliding element may be connected to the operating lever by a bent portion which is formed at the end of the former, and projects into an aperture provided at the angle of the two arms of the operating lever, and which cooperates with the lower edge of the aperture in the lever.

The hinged connection for the operating lever may be attained by the end of its rising arm simply engaging or contacting against the bottom of a cavity or recess which is formed in the lid. This cavity has a V-shaped cross-section, one of the walls of which is vertical and forms a stop at the front thereof for the rising arm of the lever when retracted into the resting position by the action of the helical coil springs. The other wall is inclined so as to allow for the rotational movement of the operating lever.

Inasmuch as the sliding element slides below the flat spring, being guided at the front thereof against lateral displacement through the intermediary of small conventional side plates extending along the side edges of the pouring spout, and somewhat ore towards the rear, by the longitudinal central aperture, the side edges of which slide with a small amount of play along the bushing of the stirring shaft, there is prevented any other kind of movement of the sliding element. Consequently, the operating lever is maintained in proper position, there being inhibited any movement of the latter, other than rotating towards the rear so as to displace the sliding element.

This then finally results in the provision of an extremely simple mechanism and, inasmuch as the flat spring is fastened to the lid by a screw, it is sufficient to merely unscrew the screw in order to be able to remove the sliding element; for example, to enable it to be cleaned.

BRIEF DESCRIPTION OF THE DRAWINGS

Reference may now be had to the following detailed description of the invention setting forth an exemplary embodiment of the lid structure, taken in conjunction with the accompanying drawings; in which.

DETAILED DESCRIPTION

Figure 1:
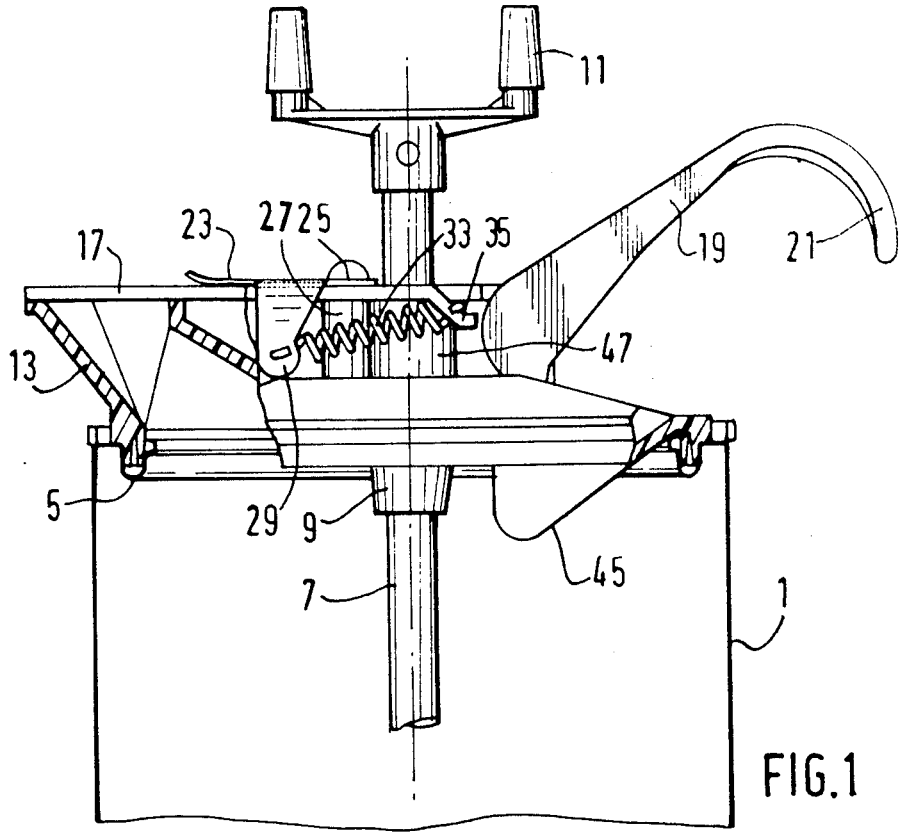
FIG. 1 illustrates partially sectional elevational view of a lid pursuant to the invention shown in the resting position.
Figure 2:
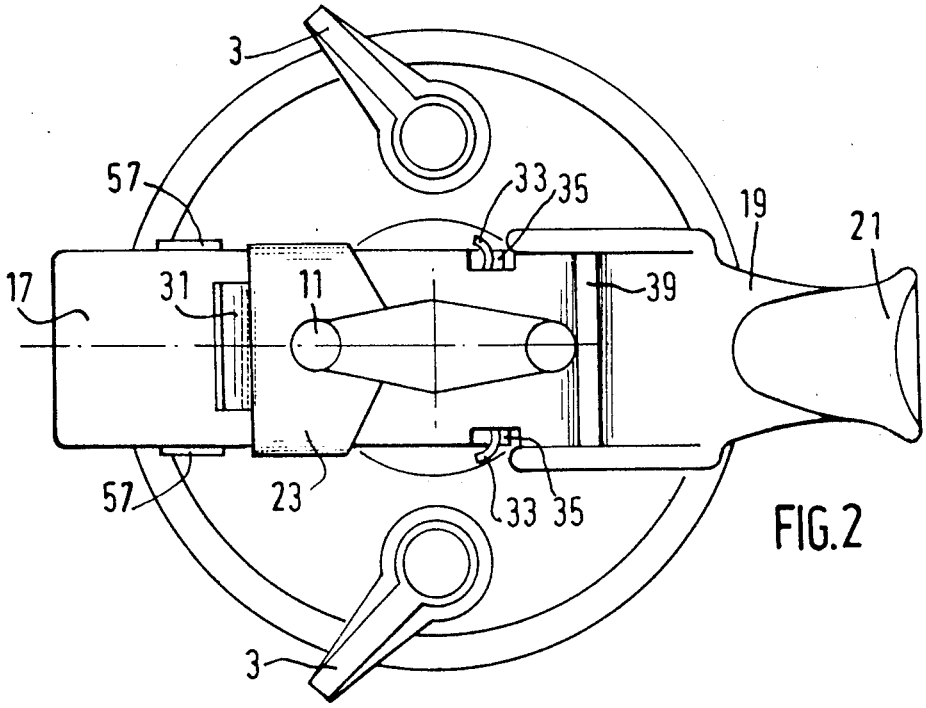
FIG. 2 illustrates a top plan view of the lid.
Figure 3:
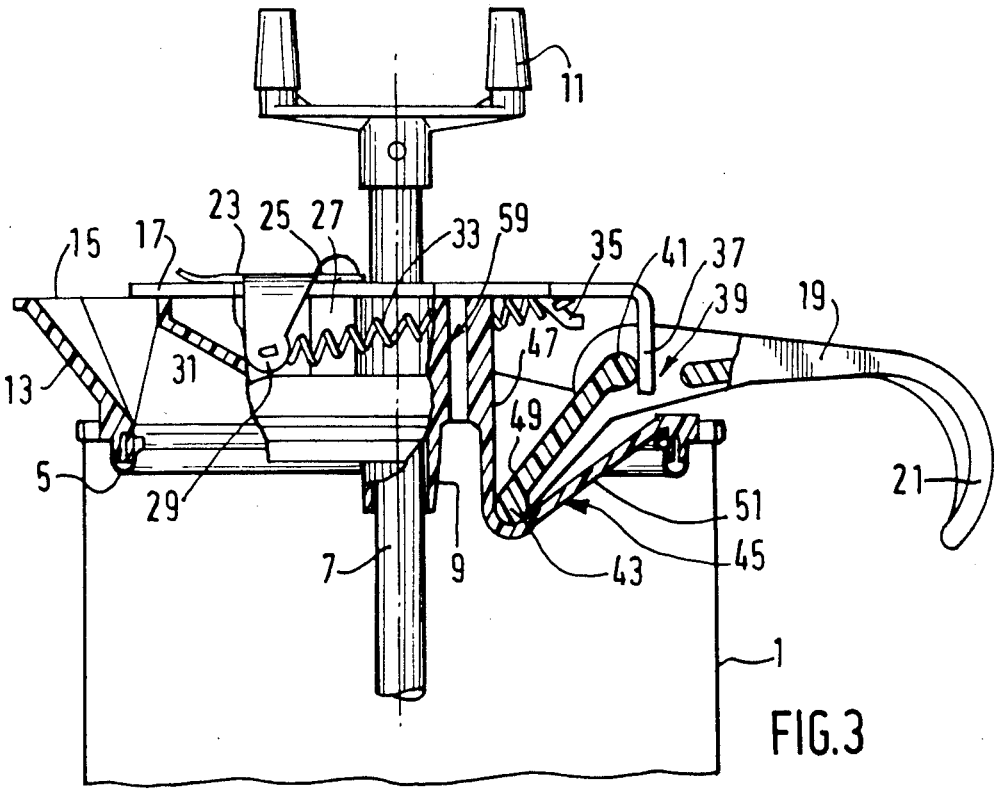
FIG. 3 illustrates a partially sectional elevational view of the lid in the working position.

With reference to FIGS. 1 to 4 of the drawings, the lid pursuant to the invention is intended to be mounted, so as to form a sealing cover, on an opened paint container 1 for a stirring machine by means of suitable cam lug locking devices 3 which fasten to the inside rim 5 of the container. The lid includes a propeller-driven mixer 7 having a vertically extending shaft, and which is connected thereto by a guide sleeve or bushing 9 and rotatably driven by the (bifurcated or pinion) drive device 11 of the stirring machine. The pouring spout 13 projects from the outer side portion of the lid and is slightly elevated or raised with respect to the upper wall of the lid, so as to facilitate the dispensing of paint. The orifice of the spout has a dihedral cross-section and the flat opening portion 15 is contacted by a sliding element 17 which is slidably mounted thereabove. Sliding element 17 closes off or seals the spout 13 in the resting position (FIGS. 1 and 2) and is activated so as to open during pouring (FIGS. 3 and 4) through the intermediary of an operating lever 19 which is provided with an end trigger 21 to facilitate withdrawal of the lid from the stirring machine with the use of only one hand.

The sliding element 17 is pressed against the opening portion 15 of the pouring spout by means of a flat spring 23 which is fastened at a rearward end to the lid by a screw 25 threaded onto a yoke 27 immediately in front of the stirring shaft 7 facing towards the pouring spout. The flat spring 23 has side lugs or flanges 29 which depend vertically along each of the side edges of the sliding element 17; and a front flange 31 possessing a rounded portion, which presses against the sliding element. Two helical coil springs 33, which extend substantially in parallel with each other, and are arranged below the side edges of the sliding element, are each attached, on the one end, to the lower ends of the lugs or flanges 29 and, at the other end, to cutaways 35 towards the rearward end of the sliding element. These coil springs exert a restoring force on the lugs 29; thereby imparting a torsional moment to the flat spring 23 about its fixing or mounting point. This torsional moment increases the force of the pressure of the front flange 31 acting on the sliding element 17.

The sliding element 17 is connected to the operating lever 19 by a rear depending bent portion 37 formed perpendicularly to its main plane. This bent portion 37 extends into a longitudinal aperture 39 formed between the two arms of the lever 19 and cooperates, by means of sliding contact, with the rounded lower edge 41 of this aperture. The operating lever 19 is hingedly connected to the lid through a simple sliding contact of its lower end 43, which also has a rounded portion, with the bottom of a V-shaped recess or cavity 45. This cavity 45 includes a first vertical wall 47 against which there abuts the upwardly extending arm 49 of the operating lever in the resting position of the lever, and a second inclined wall 51 which facilitates the rotational movement of the lever 19. The pivot axis of this rotational movement is at the end 43 of the lever 19, which rotates within the bottom end of the recess or cavity 45. Quite apparently, when the lever 19 is rotated, the element piece 17 is retracted and slides along the surface portion 15 of the pouring spout and below the flat spring 23. In effecting the foregoing, helical coil springs 33 are additionally tensioned and there is an increase in the torsional moment which is applied to the flat spring 23. Consequently, the front flange 31 imparts more pressure to the sliding element 17. It is therefore ascertainable that through such a design for the flat spring, the sliding element is caused to apply an increasing pressure as it is opened to as to, in an efficient manner, assist in the removal of any paint which is present on the opening portion of the spout after pouring, as soon as the element returns to the closed position.

The sliding element is also provided with a longitudinal central aperture 53 which has a width equal to the diameter of the bushing 9 for the stirring shaft, and which encompasses the bushing. This aperture 53 is configured such that its rearward rounded end 55 abuts against the bushing 9 of the stirring shaft in the resting position, thereby restricting the forward movement of the sliding element 17. The length of the aperture is adapted to allow for the maximum movement of the sliding element and, as a result, ensures that the front end of the element is at a sufficient distance from the fastening yoke 27 of the flat spring 23. The aperture 53 also guides the sideways or lateral motion of the sliding element 17 in addition to the conventional side plates 57 on the pouring spout and, inasmuch as the sliding element slides below the flat spring 23, the only possible movement permitted thereto is a sideways movement in the plane of the pouring spout opening portion. Similarly, as mentioned hereinbefore, the only movement which the operating lever 19 can perform is a rotational motion causing a displacement of the sliding element 17. In particular, since the lever is retained by the rearward bent portion 37 of the sliding element, it cannot escape from the recess or cavity 45.

Furthermore, the sliding element 17 is easily removable. In order to remove the element, it is sufficient to merely unscrew the fastening screw 25 of the flat spring when, after a period of time, cleaning thereof becomes necessary.

Figure 4:
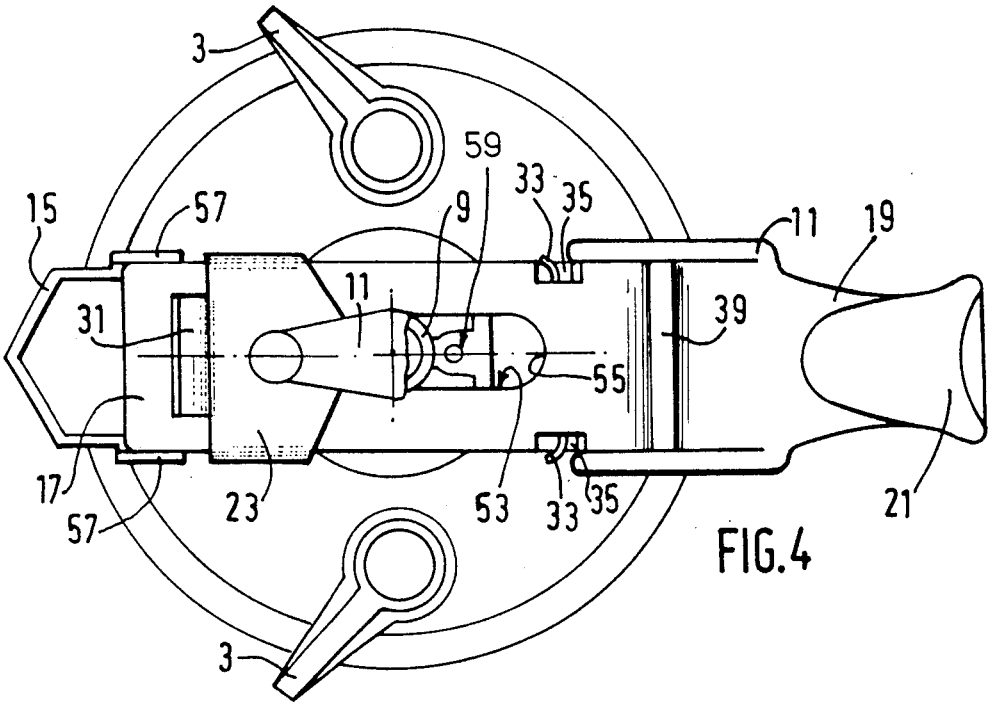
FIG. 4 illustrates a top plan view of the lid of FIG. 3.

It is also noted that the lid includes a venting passageway 59 having an orifice located behind the stirring shaft opposite the pouring spout, which venting orifice is closed off by the sliding element in the resting position of the latter, thus sealing off the contents of the container, and which is opened to the outside by the aperture 53 of the sliding element in the working position (FIG. 4). This venting passageway 59, which is located relatively distant from the pouring spout, facilitates the entry of air into the container during operation and, consequently, ensures a uniform flow of paint during pouring.

Moreover, the lid is preferably constituted from a plastic molding whereas the sliding element is made of steel. Expediently, the central portion of the structure is additionally strengthened in order to rigidly support the stirring shaft and the location at which the flat spring is fastened. This reinforced structure is obtained by arranging the fastening yoke 27 of the flat spring and the venting passageway 59 about the central bushing 9 which guides the stirring shaft. This bushing, which is constituted of high-density polyethylene and, if necessary, can be readily exchanged, prevents any paint from sticking on the stirring shaft. Similarly, paint can be prevented from sticking to surfaces in the region of the sliding element by coating the latter with an anti-adhesive material; for example, polytetrafluoroethylene (Teflon), which also improves the tightness of the closure between the sliding element and the pouring spout.

While there has been shown and described what are considered to be preferred embodiments of the invention, it will of course be understood that various modifications and changes inform or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. Lid including a pouring device for primary color or paint containers arranged on stirring machines, comprising:

(a) at least one latching member for fastening said lid onto an opened color container;

(b) a pouring spout having a flat-surfaced opening portion;

(c) a sliding element having longitudinal edges, a rearward portion, and a configuration conforming with the opening portion of said pouring spout and being slidable on the flat surface of the opening portion;

(d) an operating lever having two arms, said lever being hinged to the lid and connected with said sliding element so as to be movable between a resting position in which the sliding element closes off the pouring spout and a retracted working position facilitating pouring of the paint can be poured;

(e) a flat spring having a rearward portion fastened to the lid at a point in front of a stirring shaft of said stirring machine, said flat spring having a flange towards a front edge thereof pressing against the sliding element, and including at a distance from the fastening point to the lid, two vertically depending flanges arranged on either side thereof in close proximity to each of the longitudinal edges of the sliding element;

(f) and two helical coil springs each being connected, at one end, to one of the depending flanges on the flat spring and, at the other end, to the rearward portion of said sliding element.

2. Lid as claimed in claim 1, comprising a venting passageway therein, a flat upper part of said passageway passing below the sliding element into the sliding plane of the element, said sliding element being configured to close off said passageway in the resting position, and to open the passageway in the working position to facilitate pouring flow of the paint.

3. Lid as claimed in claim 2, wherein the sliding element includes a longitudinal central aperture having a width equal to the diameter of a bushing guiding the stirring shaft, the rearward end of the aperture abutting in the resting position thereof against the bushing, and said aperture opening the venting passageway in the working position.

4. Lid as claimed in claim 2, wherein the sliding element is connected to the operating lever by a bent portion at the rearward end of said element, said portion entering into an aperture at the angle of the two arms of the operating lever and cooperating with the lower edge of the aperture in said lever.

5. Lid as claimed in claim 1, wherein the hinging connection of the operating lever with the lid is formed by the lower end thereof resting on the bottom of a cavity in the lid, said cavity having a V-shaped cross-section, one of the walls being vertical and providing a front stop for the lever which is returned into the resting position thereof by the helical coil springs, and the other wall of which is inclined so as to allow for rotational movement of the lever.

6. Lid as claimed in claim 2, wherein the movement of the sliding element is guided by side plates extending along the edges of the pouring spout, and towards the rear by the aperture having the side edges thereof slide at a slight degree of clearance along a bushing of the stirring shaft, and guided from above by the flat spring.

7. Lid as claimed in claim 1, wherein the lid is constituted of a plastic molding, and said sliding element is made of steel.

* * * * *